US009476240B1

(12) United States Patent
Hsu

(10) Patent No.: US 9,476,240 B1
(45) Date of Patent: Oct. 25, 2016

(54) DOUBLE DOOR COORDINATOR

(71) Applicant: I-TEK METAL MFG. CO., LTD., Tainan (TW)

(72) Inventor: Wei-Chung Hsu, Tainan (TW)

(73) Assignee: I-Tek Metal Mfg. Co., Ltd, Tainan (TW)

( * ) Notice: Subject to any disclaimer, the term of this patent is extended or adjusted under 35 U.S.C. 154(b) by 0 days.

(21) Appl. No.: 14/929,509

(22) Filed: Nov. 2, 2015

(51) Int. Cl.
*E05F 5/12* (2006.01)
*E05F 3/00* (2006.01)

(52) U.S. Cl.
CPC . *E05F 5/12* (2013.01); *E05F 3/00* (2013.01); *E05Y 2900/132* (2013.01)

(58) Field of Classification Search
CPC ..... E05F 5/12; E05F 3/00; E05Y 2900/132; E05Y 2201/626; E05Y 2201/686; E05Y 2201/624; E05Y 2600/324
USPC ..... 49/364, 366, 367, 369
See application file for complete search history.

(56) References Cited

U.S. PATENT DOCUMENTS 2,015,996 A * 10/1935 Eichacker ..... E05F 5/12 49/366
3,822,506 A * 7/1974 Fishbach ..... E05F 5/12 16/82
3,895,461 A * 7/1975 Maynard, Jr. ..... E05F 5/12 16/82
4,429,492 A * 2/1984 Imhoff ..... E05F 5/12 16/82
4,949,505 A * 8/1990 Cohrs ..... E05F 5/12 49/367
4,967,512 A * 11/1990 Schroder ..... E05F 5/12 16/82
5,033,234 A * 7/1991 Simon ..... E05F 5/12 292/DIG. 21
6,742,302 B2 * 6/2004 Karkkainen ..... E05F 5/12 49/103
9,109,388 B2 * 8/2015 Tyler ..... E05F 5/12
2001/0025450 A1 * 10/2001 Juntunen ..... E05F 5/12 49/103
2014/0259933 A1 * 9/2014 Tyler ..... E05F 5/12 49/103

* cited by examiner

*Primary Examiner* — Justin Rephann
(74) *Attorney, Agent, or Firm* — Alan D. Kamrath; Kamrath IP Lawfirm, P.A.

(57) ABSTRACT

A double door coordinator includes a release mechanism mounted in a body fixed in a door frame. A restraining mechanism is operably connected to the release mechanism. An actuation mechanism is pivotably connected to the body, is restrained by the restraining mechanism, and includes a buffering spring. When the inactive door is in a non-closed position, the restraining mechanism restrains the actuation mechanism to prevent the active door from pivoting to the closed position. When the inactive door is in the closed position, the release mechanism actuates the restraining mechanism to a position not hindering movement of the actuation mechanism, permitting the active door to pivot to the closed position. When the active door pivots towards the closed position under action of a large force, the buffering spring absorbs a portion of the large force to reduce damage to the double door coordinator and the active door.

7 Claims, 15 Drawing Sheets

DOUBLE DOOR COORDINATOR

BACKGROUND OF THE INVENTION

The present invention relates to a door coordinator and, more particularly, to a double door coordinator for controlling the closing sequence of an active door and an inactive door of a double door.

A double door mounted in a building generally includes an active door and an inactive door both of which are pivotably mounted in a door frame. The active door includes a stopper plate protruding towards the inactive door. When both of the active door and the inactive door are in the closed position, the stopper plate abuts against a side of the inactive door to prevent wind and dust from entering the indoor space via the gap between the active door and the inactive door. When it is desired to close the double door, the inactive door must be closed before the active door, because the stopper plate will hinder closing of the door if the active door is closed first. To assure the inactive door is closed after the active door, a door coordinator is mounted to the door frame and includes a release mechanism associated with the inactive door and an actuation mechanism associated with the inactive active door and operably connected to the release mechanism. When the inactive door is in the closed position, the release mechanism permits the actuation mechanism to retract inwards, thereby permitting the active door to pivot to the closed position. On the other hand, when the inactive door is in a non-closed position, the release mechanism does not permit the actuation mechanism to retract inwards, thereby avoiding pivotal movement of the active door to the closed position.

Since the active door could still pivot towards the closed position for some unexpected reasons (such as by being blown by the wind) while the inactive door is in the non-closed position. The actuation mechanism cannot retract inwards when the inactive door is in the non-closed position. In this case, the inactive door could strongly impinge the actuation mechanism, causing damage to the door coordinator or the active door.

BRIEF SUMMARY OF THE INVENTION

The present invention solves this disadvantage by providing a double door coordinator including a body having a first end and a second end spaced from the first end along a longitudinal axis. The body is adapted to be fixed to a door frame. An inactive door and an active door are adapted to be mounted to the door frame. Each of the active door and the inactive door is pivotable between a closed position and a non-closed position. A lever includes a pivotal end pivotably mounted to the first end of the body. The lever further includes a driven end and a pull end. The lever is pivotable relative to the body between a protruded position in which the driven end is located outside of the body and a retracted position in which the driven end is located in the body. The driven end of the lever is adapted to be aligned with the inactive door. The lever is in the retracted position when the inactive door is in the closed position. The lever is in the protruded position when the inactive door is in the non-closed position. A supporting block is fixed between the first and second ends of the body.

The double door coordinator further includes a stopper slideably received in the body. The stopper includes a stop end and a pivotal portion. The stop end includes a first stop face and a second stop face spaced from the first stop face. The stopper is movable along the supporting block between a front position in which the second stop face abuts the supporting block and a rear position in which the second stop face is spaced from the supporting block. A return spring includes a first end mounted to the stopper and a second end mounted to the body. The return spring biases the stopper to the front position. A cable includes a first end connected to the pull end of the lever and a second end pivotably connected to the stopper. The cable moves the stopper from the front position to the rear position when the lever pivots from the protruded position to the retracted position.

The double door coordinator further includes an actuation rod having a pivotal end, an actuation end, and a groove between the actuation end and the pivotal end. The groove includes a front end and a rear end spaced from the front end along a longitudinal axis of the groove. The actuation end faces the first stop face of the stopper. The actuation rod is pivotable relative to the body about a pivotal axis between a first position in which the actuation end is located outside of the body and a second position in which the actuation end is received in the body. The actuation end of the actuation rod is adapted to be aligned with the active door. The actuation rod is in the first position when the active door is in the non-closed position. The actuation rod is in the second position when the active door is in the closed position. A restraining rod is fixed to the second end of the body and extends through the groove of the actuation rod. The actuation rod is movable relative to the stopper and the restraining rod along the longitudinal axis of the groove. The restraining rod defines the pivotal axis of the actuation rod. A buffering spring is received in the groove of the actuation rod. The buffering spring biases the actuation rod to abut against the first stop face of the stopper.

When the lever is in the protruded position, the stopper is in the front position, and the first stop face of the stopper is in a pivotal path of the actuation end of the actuation rod from the first position to the second position.

When the lever is in the retracted position, the stopper is in the rear position, and the first stop face of the stopper is outside of the pivotal path of the actuation end of the actuation rod from the first position to the second position, permitting pivotal movement of the actuation rod from the first position to the second position.

While the lever is in the protruded position and the actuation rod is in the first position, when the actuation rod is moved from the first position to the second position by an external force larger than an elastic force of the buffering spring, the actuation rod moves relative to the stopper and the restraining rod along the longitudinal axis of the groove to a position in which the actuation end of the actuation rod is spaced from the first stop face of the stopper, permitting the actuation rod to pivot from the first position to the second position. On the other hand, if the external force moving the actuation rod from the first position to the second position is smaller than the elastic force of the buffering spring, the actuation end of the actuation rod remains abutting the first stop face of the stopper, not permitting the actuation rod to pivot from the first position to the second position.

The actuation rod can further include a screw hole in a front end wall of the front end of the groove. The double door coordinator can further include a jacket mounted around the restraining rod in the rear end of the groove and fixed to the second end of the body. A pressing member is slideably received in the groove and is located between the screw hole and the buffering spring. The buffering spring includes a first end abutting against the pressing member and a second end abutting against the jacket. An adjusting screw is in threading connection with the screw hole of the actuation rod and includes an end connected to the pressing member. The adjusting screw is rotatable to push the pressing member to move along the longitudinal axis of the groove to compress or relax the buffering spring to thereby adjust the elastic force of the buffering spring.

The actuation rod can further include a first surface and a second surface. The actuation rod can further include a recessed portion between the first and second surfaces. The recessed portion includes a bottom face extending substantially perpendicular to the longitudinal axis of the groove. The front end of the groove has an end face. The screw hole extends from the bottom face through the end face of the front end of the groove. The double door coordinator can further include a buffering block pivotably received in the recessed portion of the actuation rod. The buffering block includes a follower end outside of the actuation rod and a push end received in the recessed portion of the actuation rod and abutting the bottom face of the recessed portion. The buffering block is adapted to be pressed by the active door while the active door is pivoting from the non-closed position to the closed position. When the buffering block is imparted with a momentum by the external force, the push end of the buffering block presses against the bottom face of the recessed portion to transform the momentum of the buffering block into a force along the longitudinal axis of the groove, permitting the actuation rod to slide away from the stopper along the longitudinal axis of the groove.

The supporting block can further include a lateral side and an inclined face extending from an end of the lateral side. The inclined face is at a non-parallel angle to the longitudinal axis of the body. The supporting block can further include an end face extending perpendicular to another end of the lateral side. The first and second stop faces of the stopper are substantially parallel to each other. The second stop face has two ends. Only one of the two ends of the second stop face abuts the inclined face due to the non-parallel angle between the inclined face and the longitudinal axis of the body. The pivotal portion of the stopper abuts the end face of the supporting block when the stopper is in the front position. The pivotal portion of the stopper is spaced from the end face of the supporting block when the stopper is in the rear position.

The non-parallel angle between the first stop face of the stopper and the longitudinal axis of the body can be between 25° and 45°. The non-parallel angle between the inclined face of the supporting block and the longitudinal axis of the body can be between 10° and 30°.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
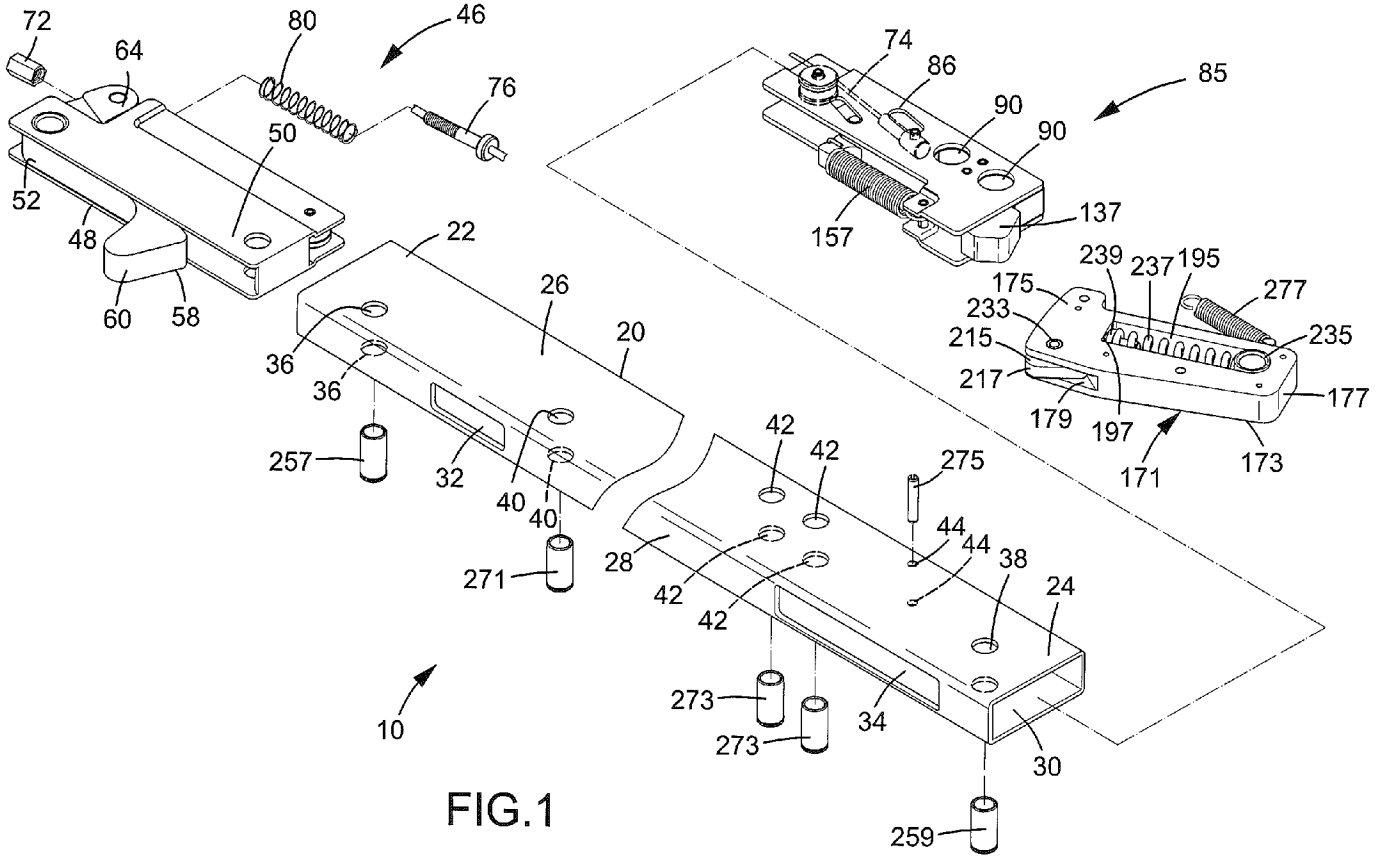
FIG. 1 is an exploded, perspective view of a double door coordinator according to the present invention.
Figure 2:
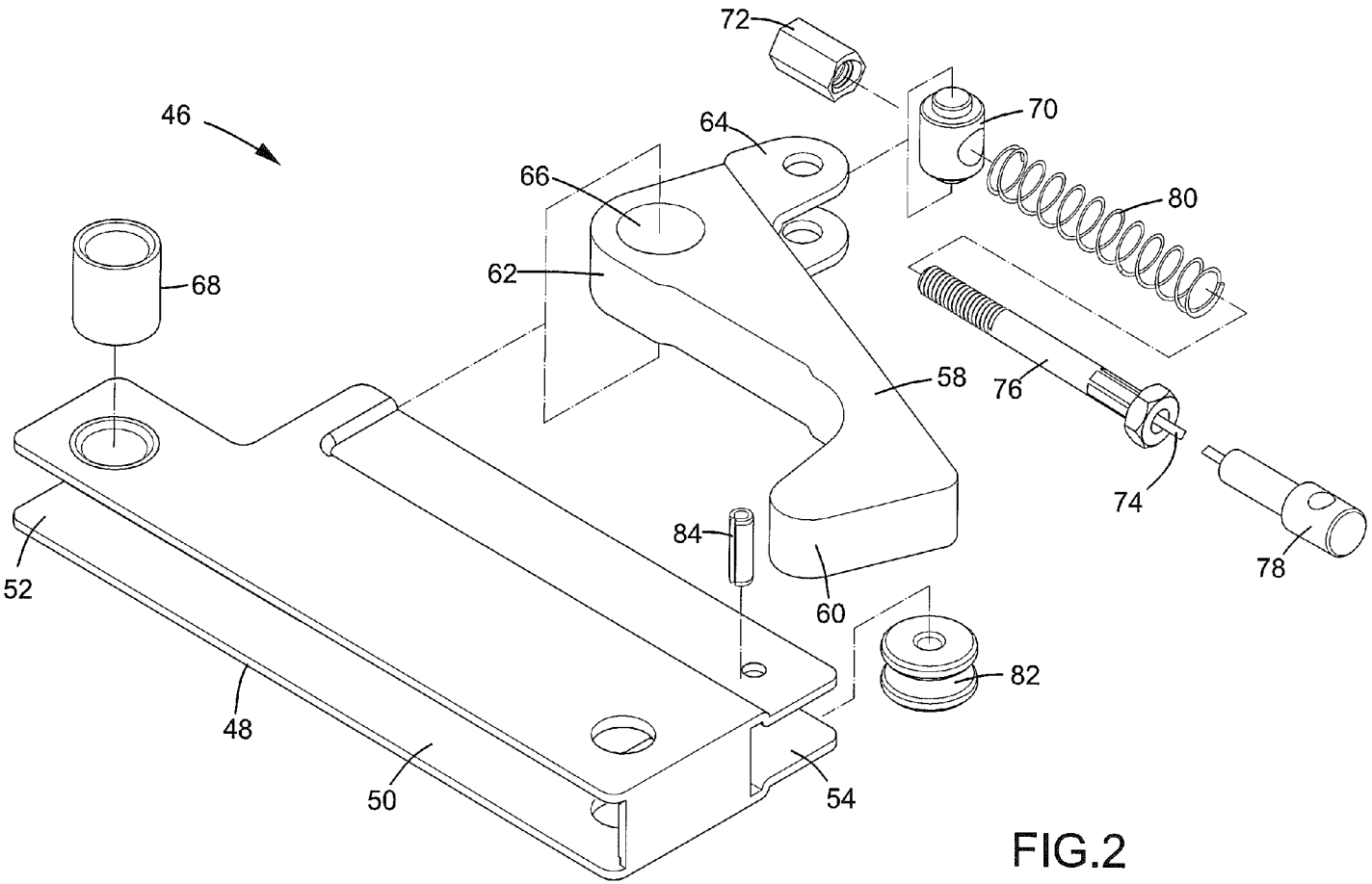
FIG. 2 is an exploded, perspective view of a release mechanism of the double door coordinator of FIG. 1.
Figure 3:
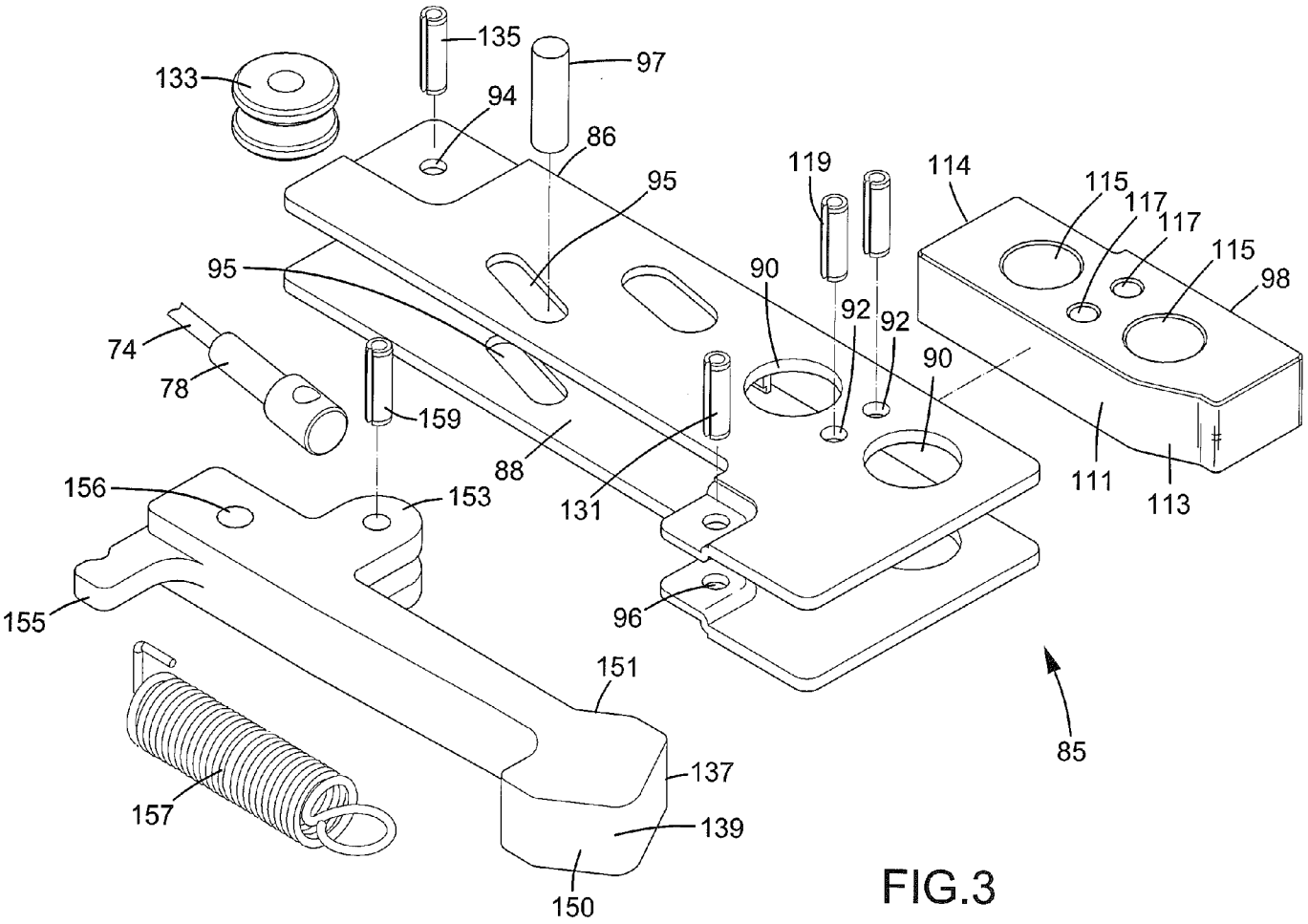
FIG. 3 is an exploded, perspective view of a restraining mechanism of the double door coordinator of FIG. 1.
Figure 4:
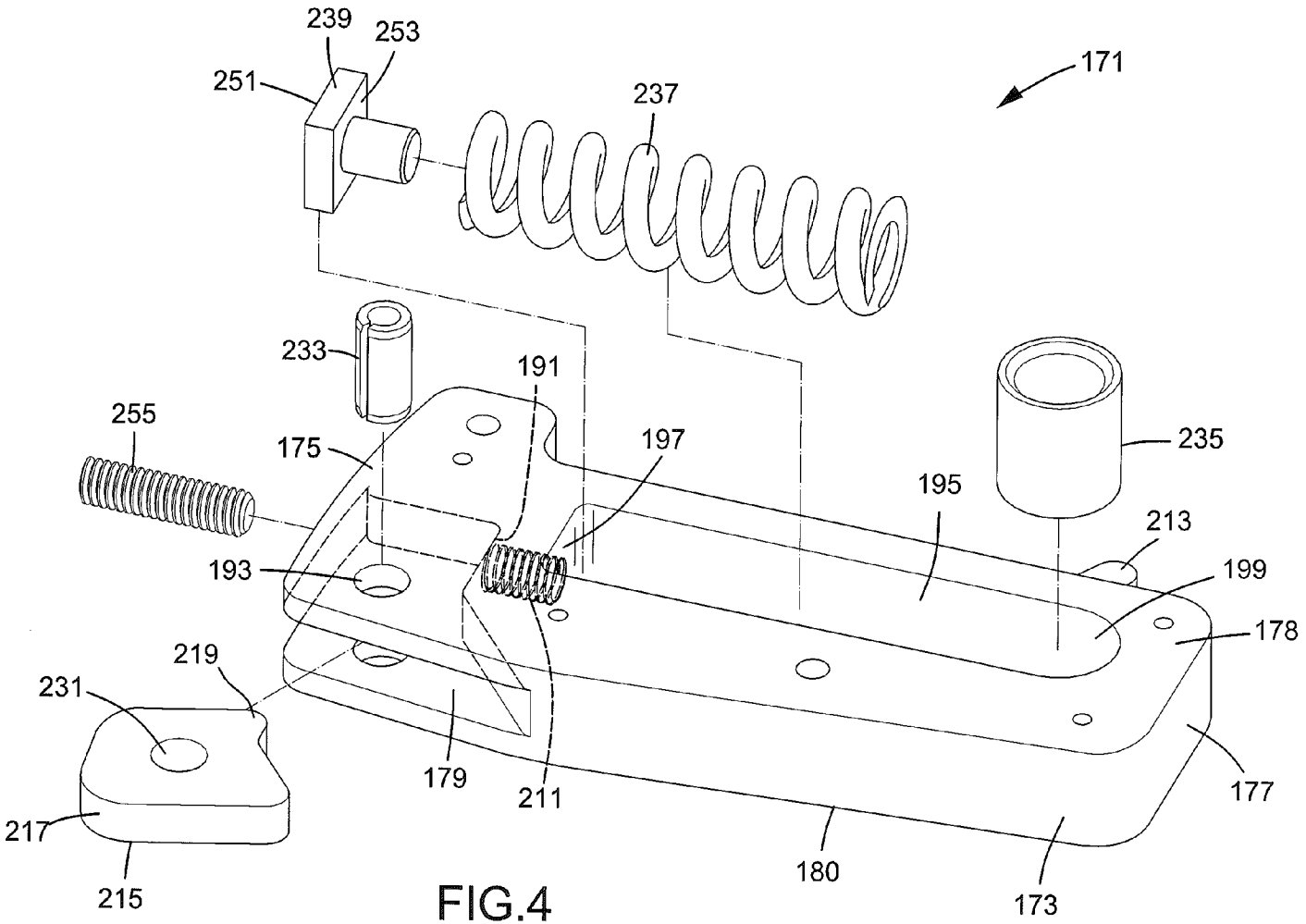
FIG. 4 is an exploded, perspective view of an actuation mechanism of the double door coordinator of FIG. 1.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "top", "bottom", "side", "end", "portion", "section", "longitudinal", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE INVENTION

A double door coordinator 10 according to the present invention is generally mounted to a door frame 291 mounted in a passage. An end of door frame 291 includes a groove 293 having a stopping portion 295. An inactive door 319 is mounted to a side of door frame 291. An active door 297 is mounted to the other side of door frame 291. Active door 297 and inactive door 319 form a double door. Inactive door 319 includes a first side 331 and a second side 333 facing door frame 291. Inactive door 319 further includes an end face 335 extending between first and second sides 331 and 333. Active door 297 includes a first side 311 and a second side 313 facing door frame 291. Active door 297 further includes an end face 315 extending between first and second sides 311 and 313 and facing inactive door 319. Active door 297 further includes a stopper plate 317 fixed to first side 311 and protruding beyond end face 315. A door closer 337 is mounted to each of first side 331 of inactive door 319 and first side 311 of active door 297.

Figure 5:
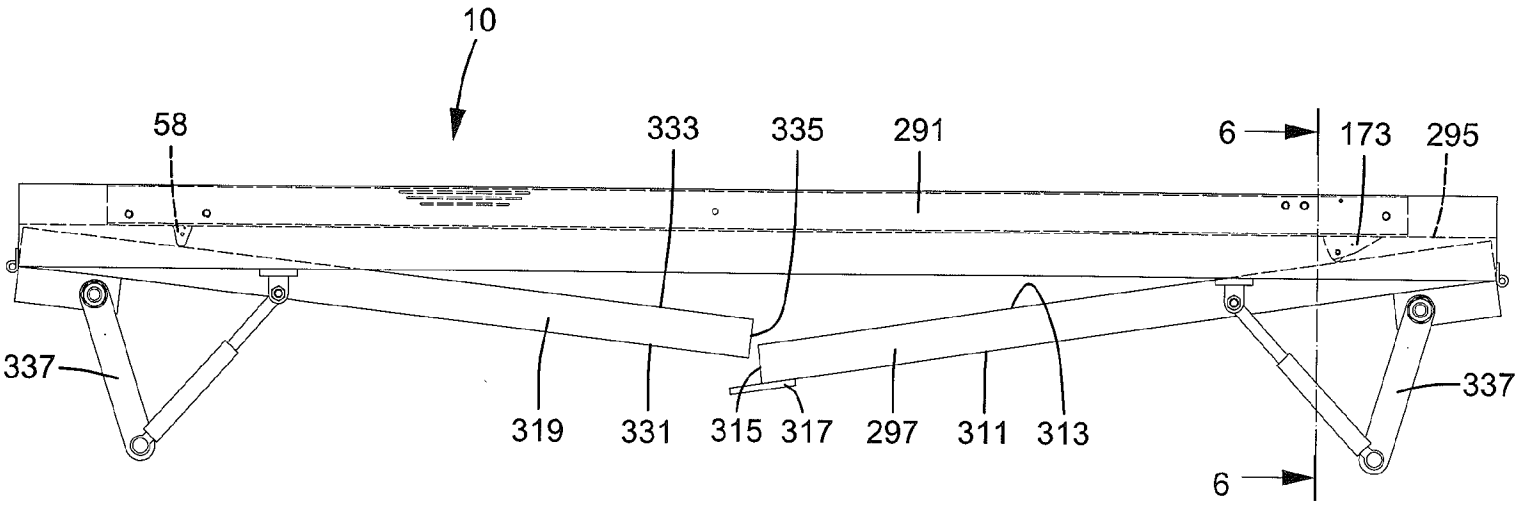
FIG. 5 is a top view of the double door coordinator mounted to a door frame.
Figure 8:
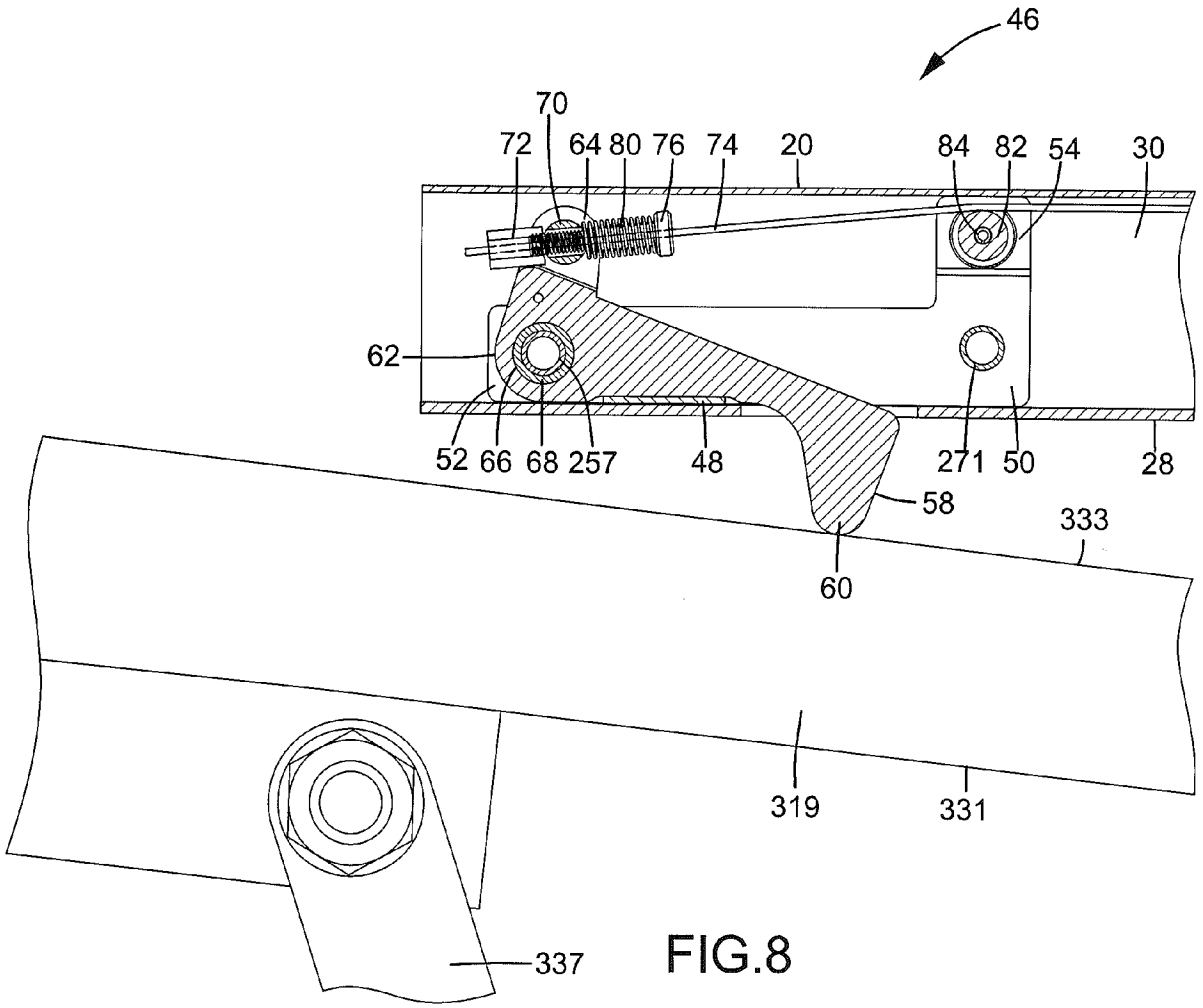
FIG. 8 is an enlarged view of a portion of the release mechanism, a portion of an inactive door, and a portion of a door closer.

Each of inactive door 319 and active door 297 is pivotable between a closed position in groove 293 of door frame 291 and a non-closed position outside of the groove 293 of door frame 291 (FIGS. 5 and 8). Door closers 337 are used to position inactive door 319 and active door 297 in the non-closed position.

According to the form shown, double door coordinator 10 includes a body 20 mounted to a top portion of door frame 291. Body 20 includes a first end 22 and a second end 24 spaced from first end 24 along a longitudinal axis of body 20. Body 20 further includes two surfaces 26 extending between first and second ends 22 and 24 and an end face 28 extending between surfaces 26. A compartment 30 extends from first end 24 through second end 24. End face 28 includes a first opening 32 defined in first end 22 and intercommunicating with compartment 30. End face 28 further includes a second opening 34 defined in second end 24 and intercommunicating with compartment 30. Each surface 26 includes a first pivotal hole 36 defined in first end 22 and intercommunicating with compartment 30. Furthermore, each surface 26 includes a second pivotal hole 38 defined in second end 24 and intercommunicating with compartment 30. Furthermore, each surface 26 includes two fixing holes 42 defined in an intermediate portion between first and second ends 22 and 24 and intercommunicating with compartment 30. Each fixing hole 42 on one of the two surfaces 26 is aligned with one of fixing holes 42 of the other surface 26. Each surface 26 further includes an engagement hole 40 and a positioning hole 44. First opening 32 is located between first pivotal holes 36 and engagement holes 40 along the longitudinal axis of body 20. Second opening 34 and positioning holes 44 are located between second pivotal holes 38 and fixing holes 42 along the longitudinal axis of body 20. Each engagement hole 40 is located between first pivotal holes 36 and fixing holes 42 along the longitudinal axis of body 20. Fixing holes 42 on each surface 26 are located between engagement holes 40 and positioning holes 44 along the longitudinal axis of body 20.

According to the form shown, double door coordinator 10 further includes a release mechanism 46 mounted to first end 22 of body 20. Release mechanism 46 includes a substantially L-shaped seat 48 having first and second engagement portions 50 and 52 aligned with each other along the longitudinal axis of body 20 and a third engagement portion 54 aligned with first engagement portion 50 in a transverse direction perpendicular to the longitudinal axis of body 20. A first roller 82 is mounted to third engagement portion 54. A pin 84 extends through third engagement portion 54 and first roller 82, permitting first roller 82 to rotate about a rotational axis defined by pin 84.

According to the form shown, double door coordinator 10 includes a lever 58 pivotably connected to seat 48. Lever 58 is received in seat 48 and includes a driven end 60, a pivotal end 62, and a pull end 64 distant driven end 60 and adjacent to pivotal end 62. Pivotal end 62 includes a sleeve receiving hole 66 aligned with second engagement portion 52. A sleeve 68 is coupled to second engagement portion 52 and is pivotably received in sleeve receiving hole 66, permitting lever 58 to pivot relative to seat 48.

A connecting member 70 is pivotably connected to pull end 64 of lever 58. A tubular member 76 extends through connecting member 70 and is attached to an end of a cable 74. Tubular member 76 includes a threaded portion in threading connection with an inner thread of an adjusting member 72. Tubular member 76 further includes an enlarged head having non-circular cross sections. Thus, tubular member 76 received in seat 48 is restrained by an inner periphery of tubular member 70 and, thus, cannot rotate. A spring 80 is mounted around tubular member 76 and is mounted between connecting member 70 and the enlarged head of tubular member 76. Spring 80 biases tubular member 76 away from connecting member 70. Thus, an end of adjusting member 72 abuts against an outer periphery of connecting member 70. When adjusting member 72 is rotated, the non-circular enlarged head cannot rotate relative to seat 48, such that the cable 74 is pulled towards or away from connecting member 70 without twisting cable 74. Furthermore, a section of cable 74 adjacent to tubular member 76 abuts first roller 82.

Figure 10:
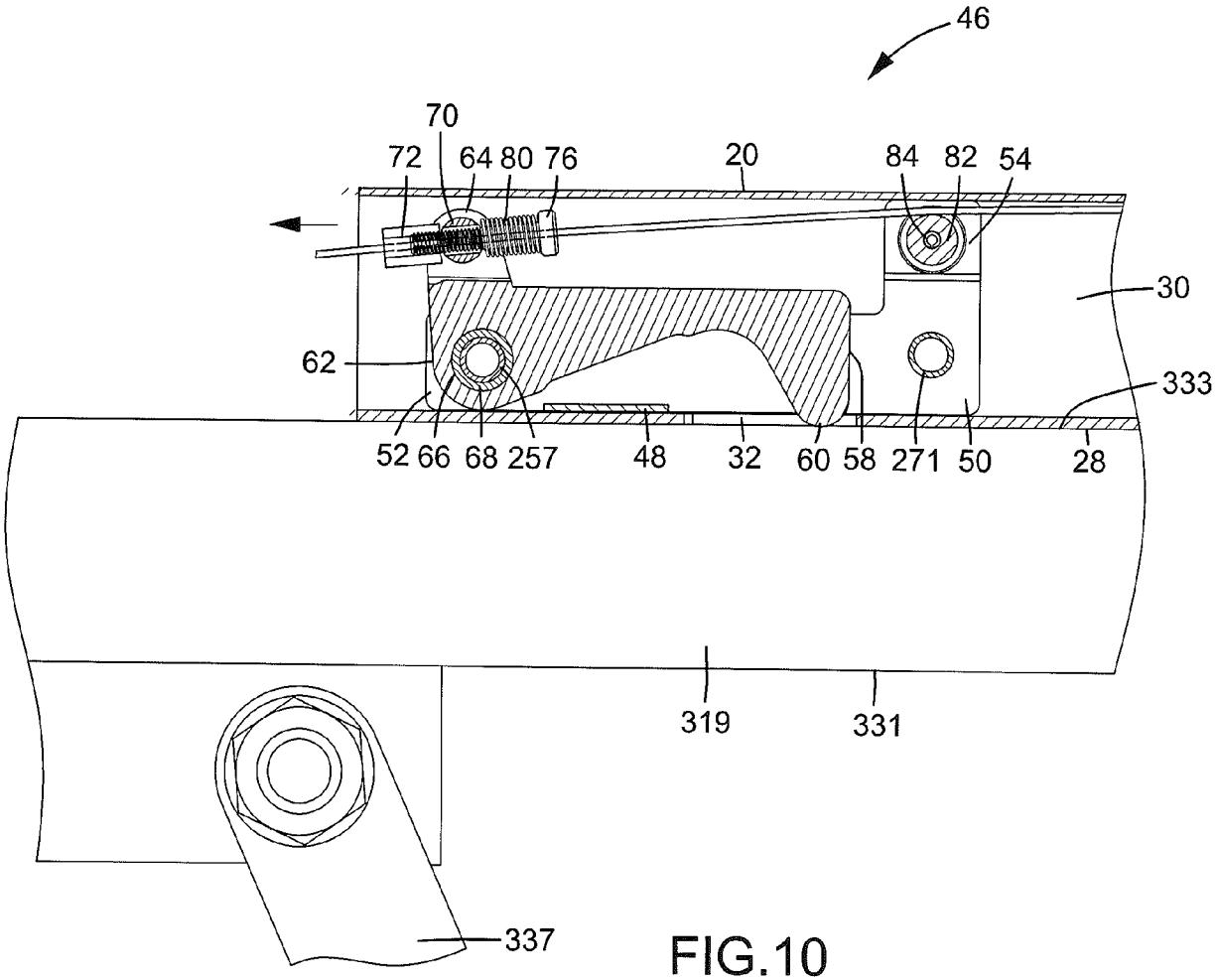
FIG. 10 is a view similar to FIG. 8 with the inactive door in a closed position.

Release mechanism 46 is received in compartment 30 of body 20 and is located in first end 22 of body 20. First engagement portion 50 of seat 48 is aligned with engagement holes 40 of body 20. Second engagement portion 52 is aligned with first pivotal holes 36 of body 20. Lever 58 is aligned with first opening 32 of body 20. Driven end 60 of lever 58 extends through first opening 32 to the outside of body 20. A pivot 257 is mounted in first pivotal holes 36 of body 20 and is pivotably mounted in sleeve 68. A first engagement member 271 in the form of a pin is mounted in engagement holes 40 of body 20 and is coupled to first engagement portion 50 of seat 48, such that seat 48 is securely fixed in compartment 30 of body 20. Nevertheless, lever 58 can pivot about a pivotal axis defined by pivot 257 between a protruded position in which driven end 60 of lever 58 is outside of body 20 (FIG. 8) and a retracted position in which driven end 60 of lever 58 is received in compartment 30 of body 20 (FIG. 10).

According to the form shown, double door coordinator 10 further includes a restraining mechanism 85 mounted in body 20. Restraining mechanism 85 includes a mounting seat 86 having two parallel, substantially L-shaped boards and a connecting wall extending between the boards. Mounting seat 86 includes a space 88. Each board of mounting seat 86 includes two first through-holes 90, two first engagement holes 92 between the two first through-holes 90, a pivotal hole 94, and a pin hole 96. One of the two first through-holes 90 of each board of mounting seat 86 is located between pivotal hole 94 and the two first engagement holes 92. Each board of mounting seat 86 further includes a track 95 that is slanted (namely, at a non-parallel angle to the longitudinal axis of body 20).

A second roller 133 is received in space 88 of mounting seat 86. A pivotal pin 135 is mounted in pivotal holes 94 of mounting seat 86 and is pivotably connected to second roller 133, permitting second roller 133 to pivot about a pivotal axis defined by pivotal pin 135.

Figure 15:
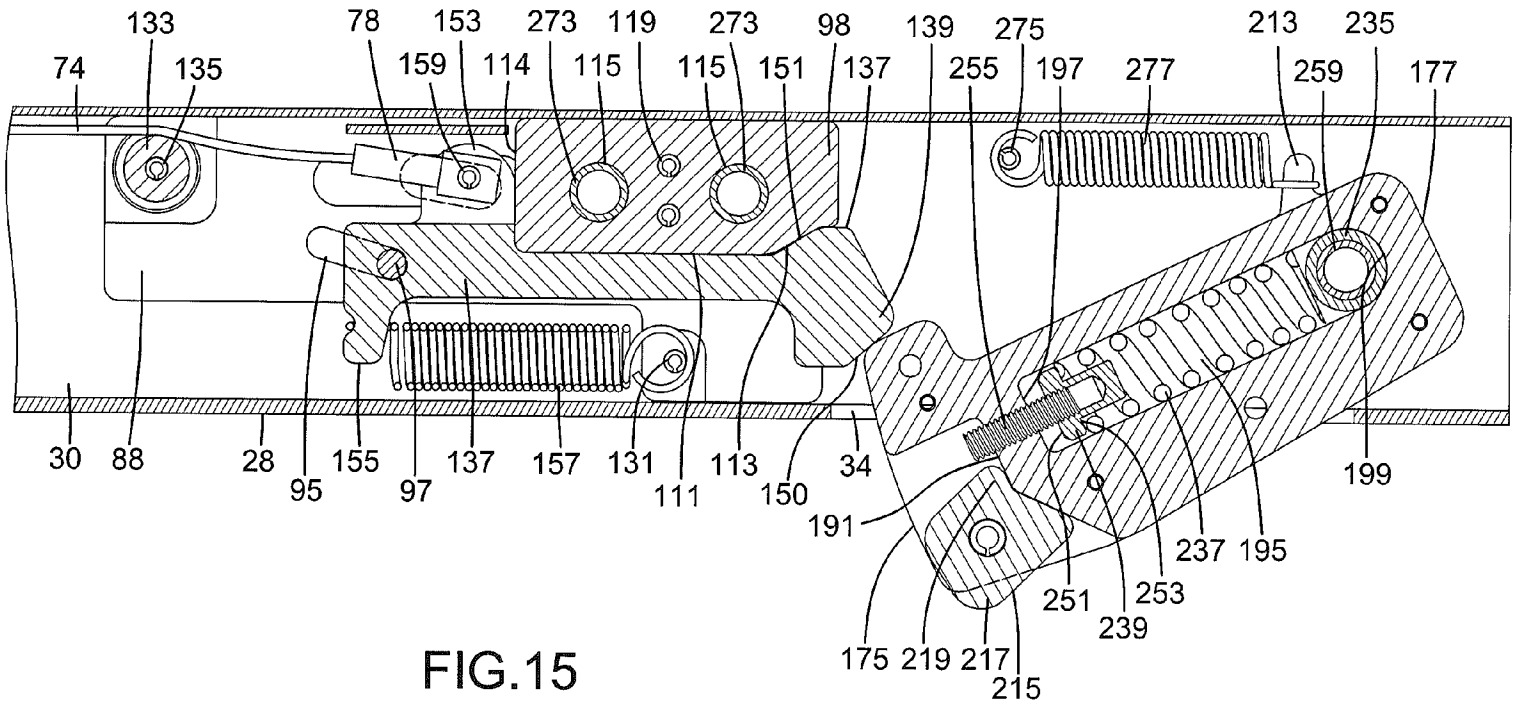
FIG. 15 is a view similar to FIG. 13, illustrating adjustment of an adjusting screw to press a buffering spring by a pressing member.

According to the form shown, restraining mechanism 85 further includes a supporting block 98 fixed in space 88 of mounting seat 86. Supporting block 98 includes a lateral side 111 and an inclined face 113 extending from an end of lateral side 111 and at a non-parallel angle B (FIG. 15) to the longitudinal axis of body 20. Non-parallel angle B is between 10° and 30°. Supporting block 98 further includes an end face 114 extending perpendicularly to the other end of lateral side 111. Supporting block 98 further includes first and second surfaces and two second through-holes 115. Each second through-hole 115 extends from the first surface through the second surface of supporting block 98. Supporting block 98 further includes two second engagement holes 117 between the two second through-holes 115. The two second engagement holes 117 of supporting block 98 are aligned with first engagement holes 92 of mounting seat 86. Second through-holes 115 of supporting block 98 are aligned with first through-holes 90 of mounting seat 86. Two engagement pins 119 are mounted in first engagement holes 92 of mounting seat 86 and second engagement holes 117 of supporting block 98 to securely fix supporting block 98 in mounting seat 86.

Figure 9:
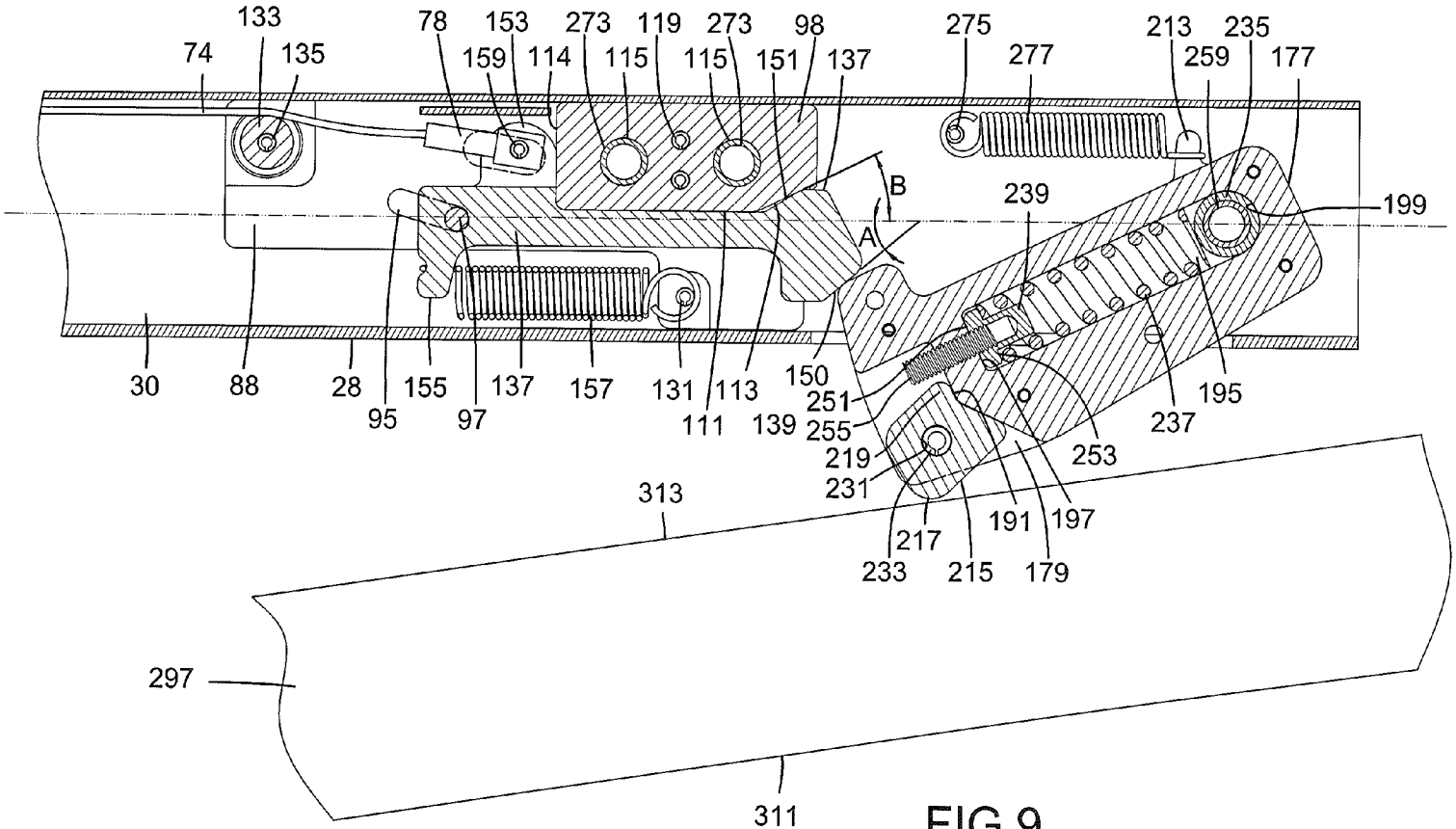
FIG. 9 is an enlarged view of a portion of the restraining mechanism, a portion of the actuation mechanism, and a portion of an active door.

According to the form shown, restraining mechanism 86 further includes a stopper 137 slideably received in space 88 of mounting seat 86. Stopper 137 includes a stop end 139 having a first stop face 150 at a non-parallel angle A (FIG. 15) to the longitudinal axis of body 20 and a second stop face 151 substantially parallel to first stop face 150. Non-parallel angle A can be between 25° and 45°. In the form shown, non-parallel angle A is 35°. Stopper 137 further includes a lug end opposite to stop end 139 and having a side with a lug 155. A pivotable portion 153 is formed on the other side of the lug end of stopper 137. Stopper 137 further includes a hole 156 extending from a surface thereof through the other surface thereof. In the form shown, hole 156 extends through the lug end opposite to stop end 139. Stopper 137 abuts against lateral side 111 of supporting block 98. Hole 156 of stopper 137 is aligned with tracks 95 of mounting seat 86. A limiting rod 97 extends through tracks 95 and is pivotably received in hole 156 of stopper 137. Stopper 137 is permitted to move between a front position (FIG. 9) and a rear position (FIG. 11) along lateral side 111 of supporting block 98. When stopper 137 is in the front position, pivotal portion 153 of stopper 137 abuts against end face 114 of supporting block 98. Since limiting rod 97 is restrained by tracks 95, the lug end of stopper 137 will not warp away from lateral side 111 of supporting block 98 under the action of a return spring 157. In this case, second stop face 151 abuts against inclined face 113 of supporting block 98. Furthermore, since second stop face 151 is not parallel to inclined face 113, only one of two ends of second stop face 151 abuts inclined face 113 of supporting block 98 when stopper 137 is in the front position. Preferably, non-parallel angle B is 20° to permit smooth movement of stopper 137 while inactive door 319 is in the closed position.

A pin 131 is mounted in pin holes 96 of mounting seat 86. An end of return spring 157 is mounted to lug 155 of stopper 137. The other end of return spring 157 is mounted to pin 131. Thus, return spring 157 biases stopper 137 to the front position.

Two second engagement members 273 are provided. Each second engagement member 273 is in the form of a pin and extends through one of first through-holes 90 of mounting seat 86, corresponding fixing holes 42 of body 20, and a corresponding second through-hole 115 of supporting block 98. Thus, mounting seat 86 and supporting block 98 are securely fixed in compartment 30 of body 20. Furthermore, the other end of cable 74 includes a cable head 78 aligned with pivotal portion 153 of stopper 137. A pin 159 is mounted to pivotal portion 153 of stopper 137 and is pivotably received in cable head 78. A section of cable 74 adjacent to cable head 78 abuts an outer periphery of second roller 133. Thus, lever 58 and stopper 137 move jointly via movement of cable 74 and stopper 137. Namely, when lever 58 moves from the protruded position to the retracted position, cable 74 and stopper 137 move from the front position to the rear position.

According to the form shown, double door coordinator 10 further includes an actuation mechanism 171 having an actuation rod 173. Actuation rod 173 includes an actuation end 175 and a pivotal end 177. Actuation rod 173 further includes a first surface 178 and a second surface 180 parallel to and spaced from first surface 178. A groove 195 is formed between actuation end 175 and pivotal end 177 and extends from first surface 178 through second surface 180. Groove 195 includes a front end 197 adjacent to actuation end 197 and a rear end 199 spaced from front end 197 along a longitudinal axis of groove 195. Actuation rod 173 further includes a recessed portion 179 formed in actuation end 175 and located between first and second surfaces 178 and 180, forming two wing portions. Recessed portion 179 includes a bottom face 191 parallel to and spaced from an end face of front end 197 of groove 195. A screw hole 211 is defined in a front end wall of front end 197 of groove 195. In the form shown, screw hole 211 extends from bottom face 191 to the end face of front end 197 of groove 195 and is, thus, in communication with front end 197 of groove 195. Actuation rod 173 further includes two first pin holes 193. Each of the two wing portions has a first pin hole 193. One of first pin holes 193 extends from first surface 178 to recessed portion 179. The other first pin hole 193 extends from second surface 180 to recessed portion 179. Actuation rod 173 further includes an ear 213 formed on a side thereof and located adjacent to pivotal end 177.

A jacket 235, a buffering spring 237, and a pressing member 239 are received in groove 195 of actuation rod 173. Jacket 235 is located in rear end 199 of groove 195. Pressing member 239 includes an enlarged portion having rectangular cross sections. The enlarged portion includes a first side 251 and a second side 253. First side 251 includes a screw hole. Pressing member 239 is located in front end 197 of groove 195. First side 251 of pressing member 239 faces screw hole 211. Buffering spring 237 is located between pressing member 239 and jacket 235. An end of buffering spring 237 abuts against second side 253 of pressing member 239. The other end of buffering spring 237 abuts against an outer periphery of jacket 235. An adjusting screw 255 is in threading connection with screw hole 211. An end of adjusting screw 255 is in threading connection the screw hole of pressing member 239. The other end of adjusting screw 255 is located in recessed portion 179.

Actuation mechanism 171 further includes a buffering block 215 received in recessed portion 179. A second pin hole 231 extends from a first side of buffering block 215 through a second side of buffering block 215 opposite to the first side of buffering block 215. Buffering block 215 further includes a follower end 217 and a push end 219 spaced from follower end 217 in a circumferential direction about a pivotal axis defined by second pin hole 231. Second pin hole 231 of buffering block 215 is aligned with first pin holes 193 of actuation rod 173. A pin 233 is mounted in first pin holes 193 of actuation rod 173 and second pin hole 231 of buffering block 215. Push end 219 of buffering block 215 abuts bottom face 191 of recessed portion 179.

Actuation mechanism 171 is received in compartment 30 of body 20. Rear end 199 of groove 195 is aligned with second pivotal holes 38 of body 20. Actuation end 175 of actuation rod 173 is aligned with second opening 34 of body 20, permitting actuation end 175 of actuation rod 173 to move through second opening 34 to the outside of body 20. A restraining rod 259 is mounted in second pivotal holes 38 of body 20 and is pivotably mounted in jacket 235, permitting actuation mechanism 171 to pivot about a pivotal axis defined by restraining rod 259 between a first position in which actuation end 175 is outside of body 20 (FIG. 11) and a second position in which actuation end 175 is located in compartment 30 of body 20 (FIG. 12).

A positioning pin 275 is mounted in positioning holes 44 of body 20. A spring 277 is mounted in compartment 30. An end of spring 277 is mounted to positioning pin 275. The other end of spring 277 is mounted to ear 213 of actuation rod 173.

Figure 6:
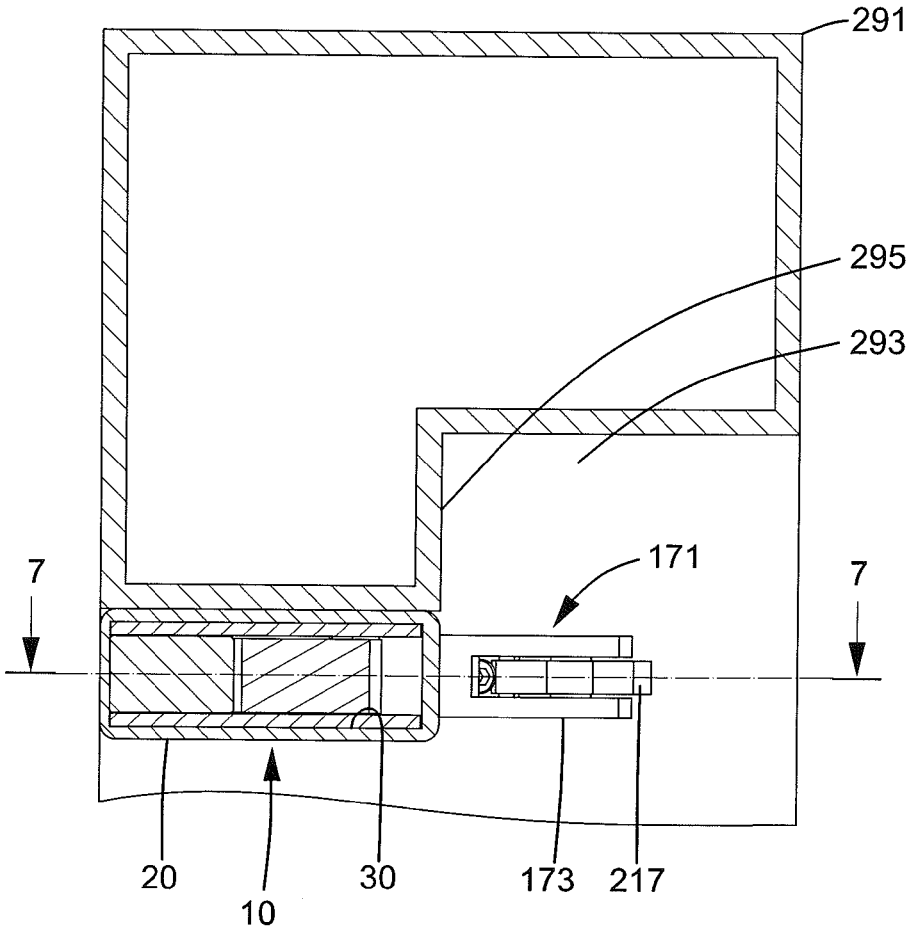
FIG. 6 is a cross sectional view taken along section line 6-6 of FIG. 5.
Figure 7:
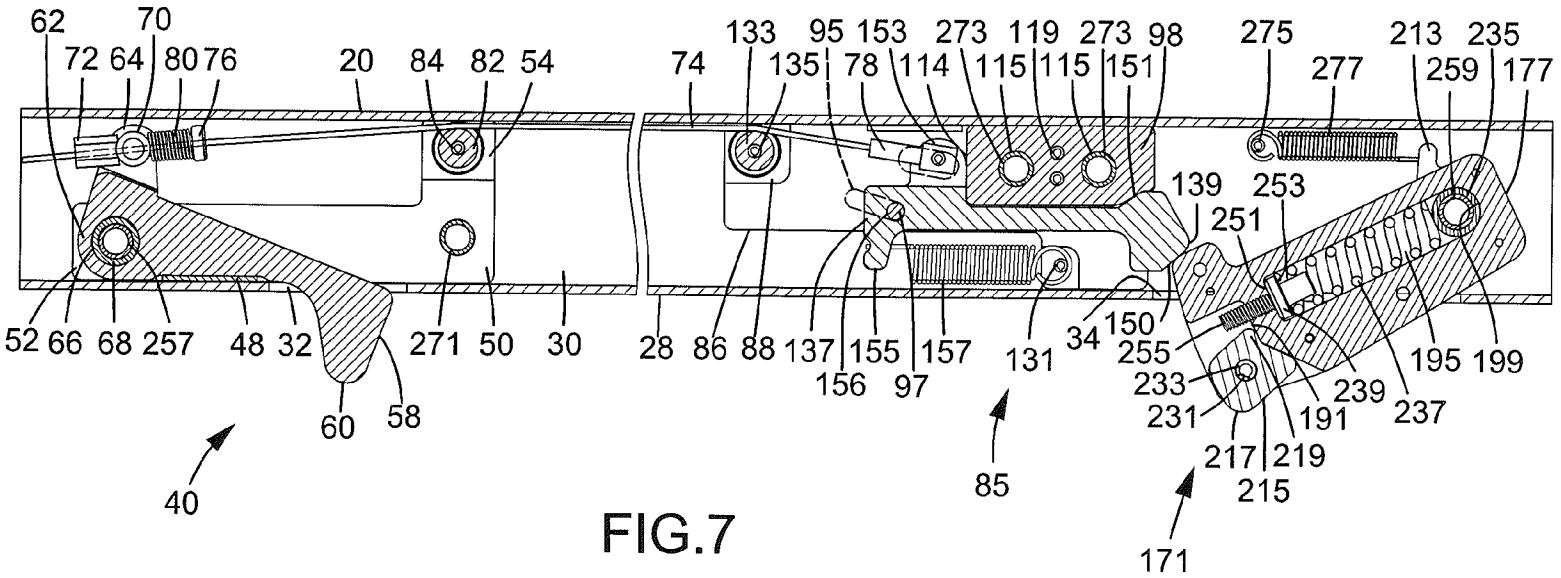
FIG. 7 is a cross sectional view taken along section line 7-7 of FIG. 6.

According to the form shown, double door coordinator 10 is mounted to a bottom face of the top portion of door frame 291. End face 28 of body 20 is aligned with stopper portion 295 of door frame 291 (FIG. 6). Driven end 60 of lever 58 of release mechanism 46 is aligned with inactive door 319. Actuation end 175 of actuation rod 173 of actuation mechanism 171 is aligned with active door 297 (FIG. 5).

Now that the basic construction of double door coordinator 10 has been explained, the operation and some of the advantages of the double door coordinator 10 can be set forth and appreciated. In particular, for the sake of explanation, it will be assumed that lever 58 is in the protruded position, and the actuation rod 173 is in the first position. Stopper 137 is biased to the front position by return spring 157, such that first stop face 150 of stopper 137 is in the pivotal path of actuation rod 173 from the first position to the second position, avoiding pivotal movement of actuation rod 173 to the second position. Thus, active door 297 cannot pivot to the closed position.

Since active door 297 includes stopper 317 protruding beyond end face 315, active door 297 can be pivoted to its closed position to completely close the double door after inactive door 318 has been pivoted to its closed position. When inactive door 319 pivots from the non-closed position to the closed position, second side 333 of inactive door 319 presses against driven end 60 of lever 58, causing pivotal movement of lever 58 from the protruded position to the retracted position. Pull end 64 of lever 58 actuates cable head 78 of cable 74 to move stopper 137 from the front position to the rear position. Since second stop face 151 abuts against inclined face 113 of supporting block 98 while stopper 137 is in the front position, when stopper 137 moves from the front position to the rear position, stop end 139 of stopper 137 moves along inclined face 113 of supporting block 98 and pivots about the pivotal axis defined by pin 159 while moving rearward (FIG. 11).

Figure 11:
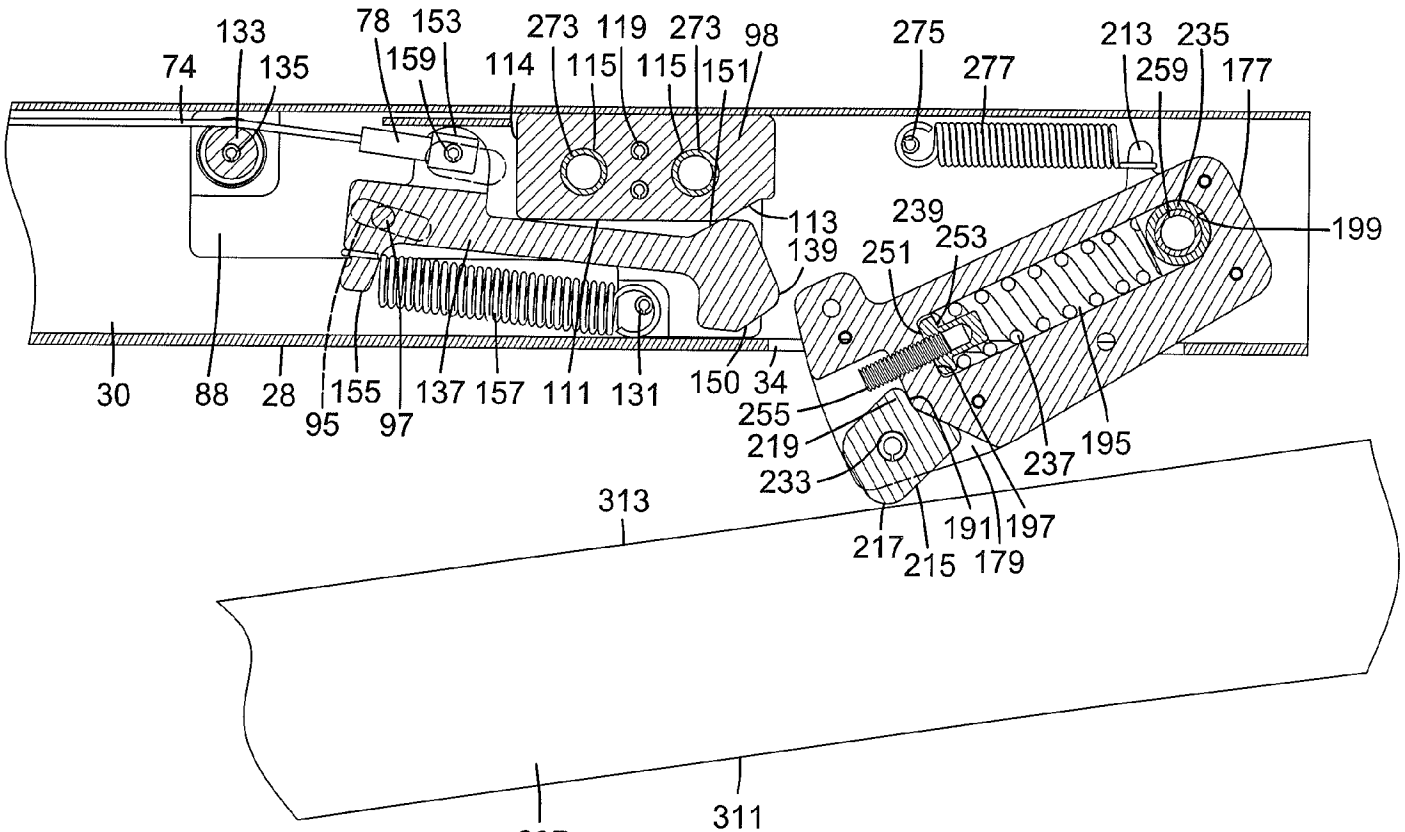
FIG. 11 is a view similar to FIG. 9 with the inactive door in the closed position.
Figure 12:
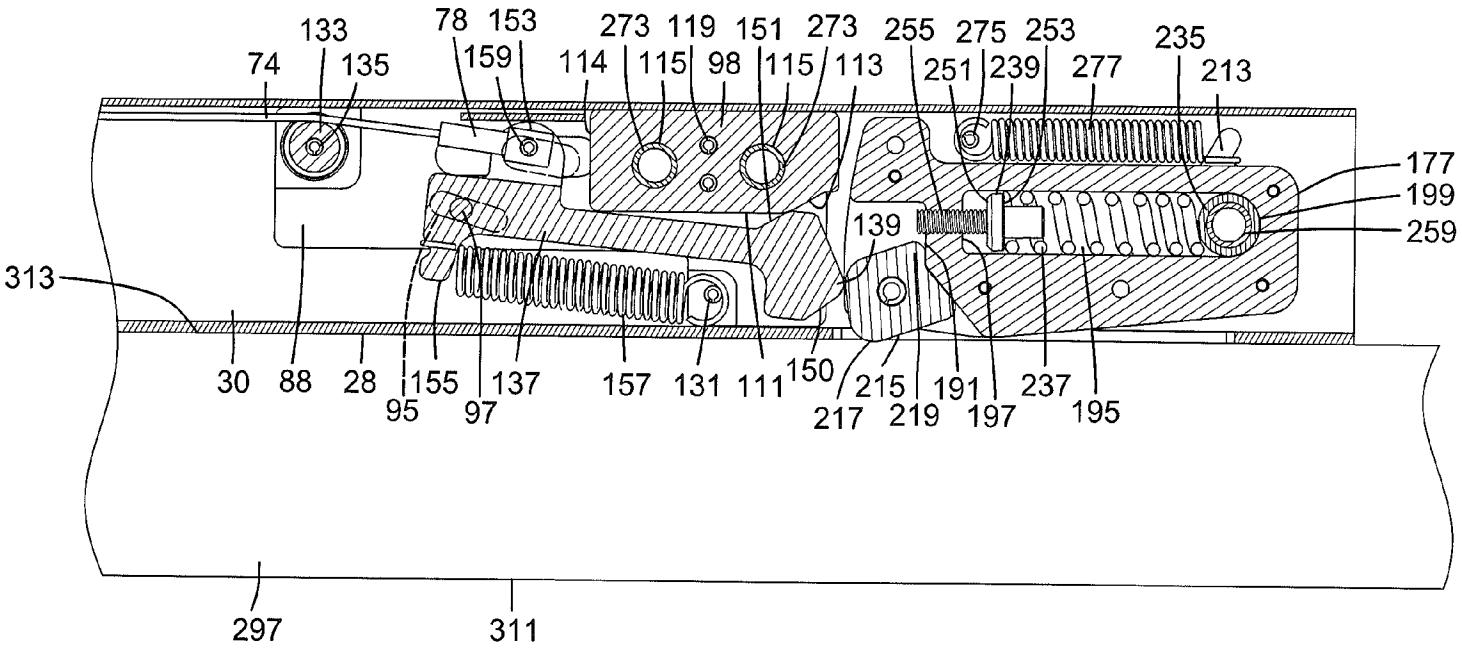
FIG. 12 is a view similar to FIG. 11 with the active door in the closed position.
Figure 13:
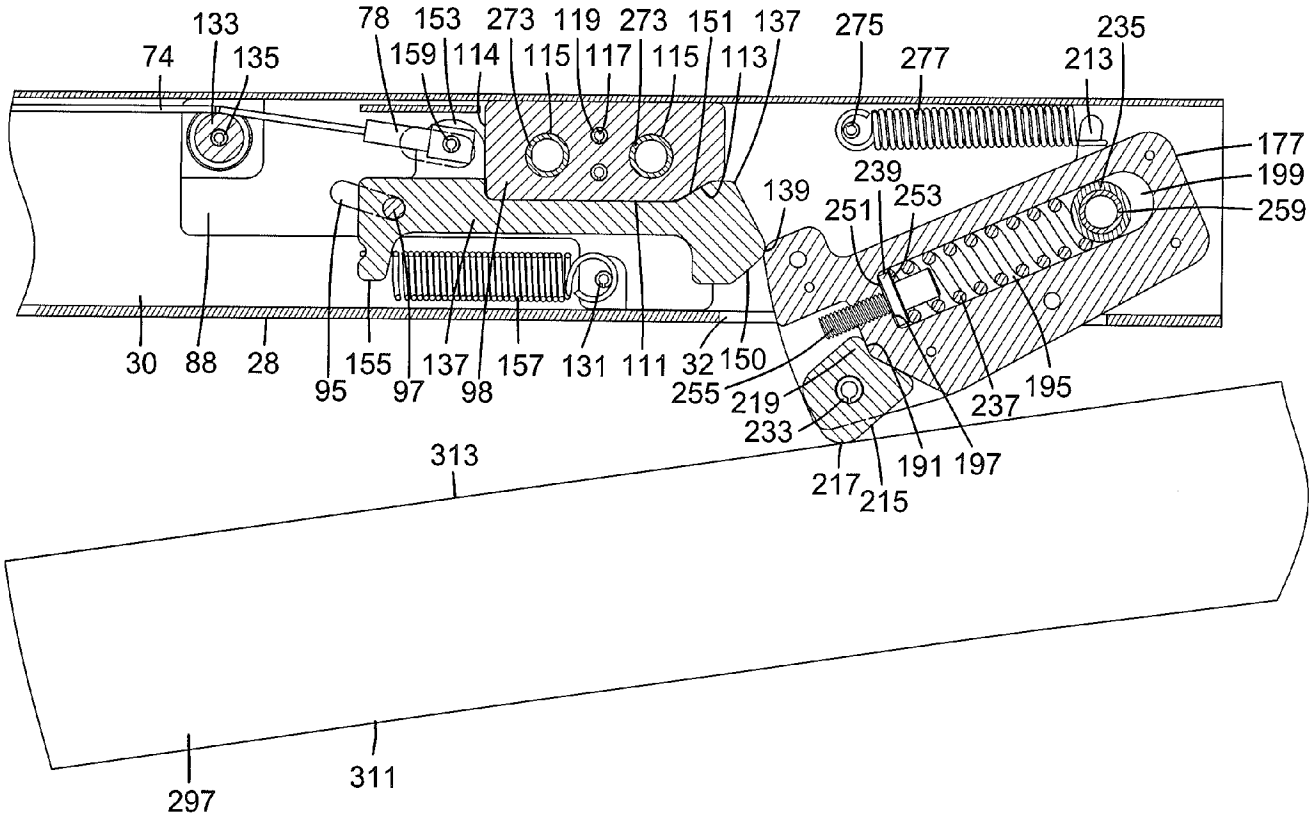
FIG. 13 is a view similar to FIG. 9 with the inactive door in a non-closed position and with the active door pressing against the actuation mechanism.
Figure 14:
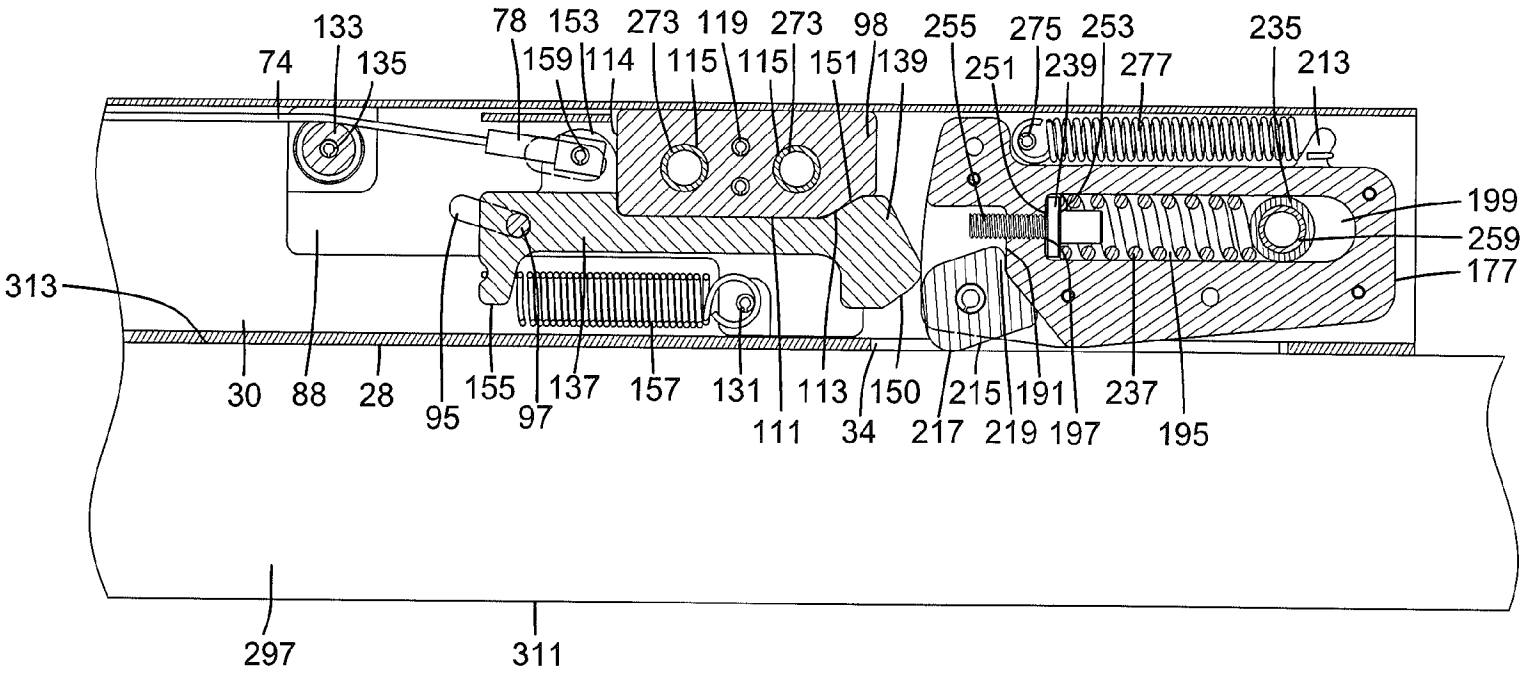
FIG. 14 is a view similar to FIG. 13 with the inactive door in the non-closed position and with the active door in the closed position.

When inactive door 319 is in the closed position, second side 333 of inactive door 319 abuts stopper portion 295 of door frame 291, lever 58 is in the retracted position (FIG. 10), and stopper 137 is in the rear position (FIG. 11). Thus, first stop face 150 of stopper 137 is located outside of the pivotal path of actuation rod 173 from the first position to the second position, such that stopper 137 will not hinder actuation rod 173, permitting active door 297 to pivot from the non-closed position to the closed position. Furthermore, second side 313 of active door 297 presses against actuation end 175 of actuation rod 173 and, thus, pivots the actuation rod 173 from the first position to the second position. When active door 297 is in the closed position, actuation rod 173 is in the second position. When both of inactive door 319 and active door 297 are in their closed positions, end face 335 of inactive door 319 is very close to end face 315 of active door 297. Furthermore, stopper 317 substantially abuts against first side 331 of inactive door 319.

Assume inactive door 319 is in the non-closed position, stopper 137 is in the front position, and actuation rod 173 is in the first position. When active door 297 is pivoted from the non-closed position towards the closed position and presses against buffering block 215, since first stop face 150 of stopper 137 is in the pivotal path of actuation rod 173 from the first position to the second position, and if the component of the force of the pivoting active door 297 imparted to actuation rod 173 along the longitudinal axis of groove 195 is smaller than the elastic force of buffering spring 237, actuation rod 173 will be stopped by stopper 137 and, thus, cannot pivot to the second position, preventing active door 297 from pivoting to the closed position.

Assume inactive door 319 is in the non-closed position. If the impact force of active door 297 (pivoting from the non-closed position to the closed position) against buffering block 215 is too large and, thus, generates a momentum on buffering block 215, and since push end 219 of buffering block 215 presses against bottom face 191 of recessed portion 179, the momentum of buffering block 215 turns into a push force along an axis parallel to a longitudinal axis of buffering spring 239, such that buffering spring 237 absorbs a portion of the impact force imparted to buffering block 215 from active door 297. Furthermore, since the first stop face 150 of stopper 137 is at a non-parallel angle to the longitudinal axis of body 20, a force component parallel to the longitudinal axis of buffering spring 237 is imparted to actuation rod 173 when active door 297 impacts buffering block 215. In a case that the active force along the longitudinal axis of groove 195 resulting from the impact of active door 297 is larger than the elastic force of buffering spring 237, actuation 173 rod compresses buffering spring 237 and moves relative to the stopper 137 and the restraining rod 259 along the longitudinal axis of groove 195 to disengage actuation end 175 of actuation rod 173 from first stop face 150 of stopper 137, permitting active door 297 to pivot to the closed position while inactive door 319 is in the non-closed position. When active door 297 reaches the closed position while inactive door 319 is in the non-closed position, buffering spring 237 returns actuation rod 173 to abut actuation end 175 of actuation rod 173 with stop end 139 of stopper 137.

In the case that both of inactive door 319 and active door 297 are in their closed positions, since inactive door 319 is stopped by stopper 317, and when it is desired to open the double door, inactive door 319 can be opened after opening active door 297. While active door 297 is pivoting from the closed position to the non-closed position, spring 277 biases actuation rod 173 to pivot from the second position to the first position. Thus, after active door 297 has pivoted to the non-closed position, actuation rod 173 returns to the first position under the bias of spring 277.

In a case that the tension of cable 74 between release mechanism 46 and restraining mechanism 85 is insufficient, adjusting member 72 can be operated to move tubular member 76 towards connecting member 70 to thereby increase the tension of cable 74, assuring joint movement of release mechanism 46 and restraining mechanism 85.

In a case that active door 297 is apt to easily pivot actuation rod 173 from the first position to the second position (and causes closing of active door 297) while inactive door 319 is in the non-closed position due to a small elastic force of buffering spring 237 of actuation mechanism 171, the adjusting screw 255 can be rotated in a direction to increase the elastic force of buffering spring 237. Specifically, since the enlarged portion of pressing member 239 has rectangular cross sections, rotation of adjusting screw 255 in the direction presses against pressing member 239 and moves pressing member 239 towards rear end 199 of groove 195 and, thus, compresses buffering spring 237, thereby increasing the elastic force of buffering spring 237. Thus, it is more difficult for actuation rod 173 to pivot from the first position to the second position while inactive door 319 is in the non-closed position.

On the other hand, if it is very difficult for actuation rod 173 to pivot from the first position to the second position while inactive door 319 is in the non-closed position, adjusting screw 255 can be rotated in a reverse direction to release pressing member 239. Buffering spring 237 pushes pressing member 239 towards front end 197 of groove 195 and, thus, relaxes. Thus, the elastic force of buffering spring 237 is reduced. As a result, it is easier for actuation rod 173 to pivot from the first position to the second position while inactive door 319 is in the non-closed position.

By providing buffering spring 237 in actuation rod 173 to permit movement of actuation rod 173 towards buffering spring 237 along the longitudinal axis of groove 195 while the external force along the longitudinal axis of groove 195 is larger than the elastic force of buffering spring 237, the impact force of active door 297 can be absorbed to reduce the possibility of damage to double door coordinator 10 and active door 297. Non-parallel angle A can prevent stopper 171 from being squeezed and moved by actuation mechanism 171.

Furthermore, tubular member 76 of cable 74 is coupled to connecting member 70 that is pivotable relative to lever 58, such that cable head 78 of cable 74 can pivot relative to pivotal portion 153 of stopper 137. Thus, when lever 58 pivots between the protruded position and the retracted position, the lug end of cable 74 adjacent to tubular member 76 will not bend. Furthermore, pivotal movement of stopper 137 between the front position and the rear position will not bend the other end of cable 74 adjacent to cable head 74. Thus, cable 74 will not have an excessive bending angle, such that lever 58 can smoothly move stopper 137 through cable 74.

Now that the basic teachings of the present invention have been explained, many extensions and variations will be obvious to one having ordinary skill in the art. For example, release mechanism 46 does not have to include seat 48 and sleeve 68. In this case, lever 58 can directly be pivotably connected to first pivotal holes 36 of body 20, and first roller 82 can directly be pivotably connected to body 20. Furthermore, restraining mechanism 85 does not have to include mounting seat 86. In this case, supporting block 98 can directly be coupled to body 20, and stopper 137 can be slideably received in compartment 30 of body 20. Furthermore, body 20 can include only one first pivotal hole 36, only one second pivotal hole 38, and only one fixing hole 42.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. A double door coordinator comprising:

a body including a first end and a second end spaced from the first end along a longitudinal axis, with the body adapted to be fixed to a door frame, with an inactive door and an active door adapted to be mounted to the door frame, with each of the active door and the inactive door pivotable between a closed position and a non-closed position;

a lever including a pivotal end pivotably mounted to the first end of the body, with the lever further including a driven end and a pull end, with the lever pivotable relative to the body between a protruded position in which the driven end is located outside of the body and a retracted position in which the driven end is located in the body, with the driven end of the lever adapted to be aligned with the inactive door, wherein the lever is in the retracted position when the inactive door is in the closed position, and wherein the lever is in the protruded position when the inactive door is in the non-closed position;

a supporting block fixed between the first and second ends of the body;

a stopper slideably received in the body, with the stopper including a stop end and a pivotal portion, with the stop end including a first stop face and a second stop face spaced from the first stop face, with the stopper movable along the supporting block between a front position in which the second stop face abuts the supporting block and a rear position in which the second stop face is spaced from the supporting block;

a return spring including a first end mounted to the stopper and a second end mounted to the body, with the return spring biasing the stopper to the front position;

a cable including a first end connected to the pull end of the lever and a second end pivotably connected to the stopper, with the cable moving the stopper from the front position to the rear position when the lever pivots from the protruded position to the retracted position;

an actuation rod including a pivotal end, an actuation end, and a groove between the actuation end and the pivotal end, with the groove including a front end and a rear end spaced from the front end along a longitudinal axis of the groove, with the actuation end facing the first stop face of the stopper, with the actuation rod pivotable relative to the body about a pivotal axis between a first position in which the actuation end is located outside of the body and a second position in which the actuation end is received in the body, with the actuation end of the actuation rod adapted to be aligned with the active door, wherein the actuation rod is in the first position when the active door is in the non-closed position, and wherein the actuation rod is in the second position when the active door is in the closed position;

a restraining rod fixed to the second end of the body and extending through the groove of the actuation rod, with the actuation rod movable relative to the stopper and the restraining rod along the longitudinal axis of the groove, and with the restraining rod defining the pivotal axis of the actuation rod, a buffering spring received in the groove of the actuation rod, with the buffering spring biasing the actuation rod to abut against the first stop face of the stopper, wherein when the lever is in the protruded position, the stopper is in the front position, the first stop face of the stopper is in a pivotal path of the actuation end of the actuation rod from the first position to the second position, wherein when the lever is in the retracted position, the stopper is in the rear position, the first stop face of the stopper is outside of the pivotal path of the actuation end of the actuation rod from the first position to the second position, permitting pivotal movement of the actuation rod from the first position to the second position, with the lever in the protruded position and with the actuation rod in the first position, when the actuation rod is moved from the first position to the second position by an external force larger than an elastic force of the buffering spring, the actuation rod moves relative to the stopper and the restraining rod along the longitudinal axis of the groove to a position in which the actuation end of the actuation rod is spaced from the first stop face of the stopper, permitting the actuation rod to pivot from the first position to the second position, and with the lever in the protruded position and with the actuation rod in the first position, when the external force moving the actuation rod from the first position to the second position is smaller than the elastic force of the buffering spring, the actuation end of the actuation rod remains abutting the first stop face of the stopper, not permitting the actuation rod to pivot from the first position to the second position.

2. The double door coordinator as claimed in claim 1, with the actuation rod further including a screw hole in a front end wall of the front end of the groove, with the double door coordinator further comprising:

a jacket mounted around the restraining rod in the rear end of the groove and fixed to the second end of the body;

a pressing member slideably received in the groove and located between the screw hole and the buffering spring, with the buffering spring including a first end abutting against the pressing member and a second end abutting against the jacket; and an adjusting screw in threading connection with the screw hole of the actuation rod, with the adjusting screw including an end connected to the pressing member, wherein the adjusting screw is rotatable to push the pressing member to move along the longitudinal axis of the groove to compress or relax the buffering spring to thereby adjust the elastic force of the buffering spring.

3. The double door coordinator as claimed in claim 2, with the actuation rod further including a first surface and a second surface, with the actuation rod further including a recessed portion between the first and second surfaces, with the recessed portion including a bottom face extending substantially perpendicular to the longitudinal axis of the groove, with the front end of the groove having an end face, with the screw hole extending from the bottom face through the end face of the front end of the groove, with the double door coordinator further comprising:

a buffering block pivotably received in the recessed portion of the actuation rod, with the buffering block including a follower end outside of the actuation rod and a push end received in the recessed portion of the actuation rod and abutting the bottom face of the recessed portion, wherein the buffering block is adapted to be pressed by the active door while the active door is pivoting from the non-closed position to the closed position, wherein when the buffering block is imparted with a momentum by the external force, the push end of the buffering block presses against the bottom face of the recessed portion to transform the momentum of the buffering block into a force along the longitudinal axis of the groove, permitting the actuation rod to slide away from the stopper along the longitudinal axis of the groove.

4. The double door coordinator as claimed in claim 1, with the supporting block further including a lateral side and an inclined face extending from an end of the lateral side, with the inclined face being at a non-parallel angle to the longitudinal axis of the body, with the supporting block further including an end face extending perpendicular to another end of the lateral side, with the first and second stop faces of the stopper substantially parallel to each other, with the second stop face having two ends, with only one of the two ends of the second stop face abutting the inclined face due to the non-parallel angle between the inclined face and the longitudinal axis of the body, wherein the pivotal portion of the stopper abuts the end face of the supporting block when the stopper is in the front position, and wherein the pivotal portion of the stopper is spaced from the end face of the supporting block when the stopper is in the rear position.

5. The double door coordinator as claimed in claim 4, wherein a non-parallel angle between the first stop face of the stopper and the longitudinal axis of the body is between 25° and 45°, and wherein the non-parallel angle between the inclined face of the supporting block and the longitudinal axis of the body is between 10° and 30°.

6. The double door coordinator as claimed in claim 5, wherein the non-parallel angle between the first stop face of the stopper and the longitudinal axis of the body is 35°.

7. The double door coordinator as claimed in claim 1, wherein an angle between the first stop face of the stopper and the longitudinal axis of the body is between 25° and 45°.

* * * * *